United States Patent [19]

Omholt

[11] 4,238,914

[45] Dec. 16, 1980

[54] RESILIENTLY CUSHIONED ADHESIVE-APPLIED REBOUND WALL SURFACING SYSTEM AND METHOD OF CONSTRUCTION

[76] Inventor: Ray E. Omholt, Mid-Atlantic Park, 590 Grove Rd., Thorofare, N.J. 08086

[21] Appl. No.: 593,608

[22] Filed: Jul. 7, 1975

Related U.S. Application Data

[63] Continuation-in-part of Ser. No. 339,496, Mar. 8, 1973, Pat. No. 3,893,275.

[51] Int. Cl.[3] ..... E04B 2/00

[52] U.S. Cl. ..... 52/309.3; 52/391; 52/403; 52/746

[58] Field of Search ..... 52/746, 403, 480, 479, 52/391, 309.3

[56] References Cited

U.S. PATENT DOCUMENTS

| | | | |
|---|---|---|---|
| 2,531,128 | 11/1950 | Hobbs | 52/746 |
| 3,432,451 | 3/1969 | Kales | 404/19 |

OTHER PUBLICATIONS

The Condensed Chemical Dictionary, 5th Edition, 1956, p. 195, by Reinhold Publishing Co.

*Primary Examiner*—John E. Murtagh

*Attorney, Agent, or Firm*—Seidel, Gonda, Goldhammer & Panitch

[57] ABSTRACT

A resiliently impact cushioned adhesive-applied restricted growth low profile wall surfacing system for use in sports activities is provided. The wooden or composition wall members are held in place by spaced ridged elastomeric cushioning adhesive material between the wall members and the receiving surface. The elastomeric cushioning adhesive material has sufficient gripping and tensile strength to overcome normal horizontal and buckling expansive forces which can be generated by an increased moisture content within the wall members during periods of atmospheric moisture changes. The elastomeric cushioning adhesive material also provides substantial resilient cushioned support behind the wall members to assure desired ball rebound action, and to absorb ball impact sounds within the confines of the playing court, and provides a substantially planar wall even though the receiving surface may be relatively non-planar.

13 Claims, 5 Drawing Figures

RESILIENTLY CUSHIONED ADHESIVE-APPLIED REBOUND WALL SURFACING SYSTEM AND METHOD OF CONSTRUCTION

RELATED APPLICATION

This application is a continuation-in-part of my copending application Ser. No. 339,496 filed Mar. 8, 1973 now U.S. Pat. No. 3,893,275.

This invention pertains to the field of rebound wall surfacing systems of the type wherein the receiving surface is covered with resiliently cushioned adhesive-applied wooden or composition wall members. Rebound wall systems are in common use in squash courts, handball courts, racketball courts, and the like. The method of construction is simple and inexpensive.

Rebound walls require a flat outer surface with essentially no openings between wall members to achieve a desired appearance and to minimize maintenance. Rebound walls must also withstand normal use without buckling, warping, or forming other surface irregularities. In addition, the rebound wall should ideally be provided with a uniform cushioned support to provide desired ball rebound action, as well as to absorb ball impact sounds. The stability, planarity, and resilient impact cushioning of the rebound wall are all essential for providing an economical, and uniformly satisfactory rebound wall system which has an excellent appearance.

Rebound wall members are normally installed at a controlled moisture content of approximately 8% to 9%. After installation, and during dry cold winter seasons when room temperature is maintained at approximately 70° F., the moisture content of the rebound wall members may drop to approximately 6% to 7%, and this can cause minor shrinkage of the rebound wall members. However, a drop in moisture content of less than 3% normally causes only minor shrinkage within the rebound wall members. Since open cracks of 1/32" or more between rebound wall members are visually objectionable and substantially increase maintenance, an upper installation moisture content of 8% to 9% is normally adhered to in geographical areas requiring artificial heat during summer months.

During spring, summer, and fall months, humidity and condensation conditions are more aggravated than they are in winter months and normally increase the moisture content of the rebound wall members above the level at which they were installed. This gives rise to expansion forces within the rebound wall members. These forces are directly related to the increased moisture content of the rebound wall members. A moisture content of 9% to 11% in the rebound wall members is not unusual during the summer months.

As the moisture content of the rebound wall members increases above the moisture content at the time of installation, the rebound wall members expand if permitted to do so. If lateral expansion is limited, such as by perimeter walls, or by the gripping and tensile strength of the adhesive, the lateral expansion force translates itself into a buckling force. Buckling is defined as the condition which exists when rebound wall members separate from the receiving surface.

In a resiliently cushioned restricted-growth, adhesive-applied rebound wall system, it is, therefore, necessary for the adhesive to not only restrict the lateral growth of rebound wall members during periods of increased moisture content, but it is also necessary to restrict potential buckling displacement of the rebound wall members.

If a rebound wall system is to maintain an essentially monolithic appearance during normal moisture change cycles, it is desirable that it be installed at a moisture content approximately three moisture content percentage points higher than the lowest average level which is anticipated during dry winter months; and it is further necessary that the adhesive securing the rebound wall members to the receiving surface has sufficient gripping and tensile strength to control normal expansion and buckling forces which exist during damper periods of the year.

Rebound wall surfacing systems for use in sports activity have met with rapidly increased popularity. The walls are used in the play of squash, handball, racketball, variations of tennis, and the like.

The rebound wall face should be resistant to cuts and dents which may be caused by racket hits and should be resistant to localized impact spalling which may be caused by ball hits, a phenomenon frequently observed with plaster wall surfacing. The wall system should be constructed of material which is resistant to condensation, especially at the 40° F. to 70° F. temperatures at which squash and handball are usually played. The wall system should have the lowest possible profile, especially when being used to renovate an existing defective playing surface. This is important in order to maintain the integrity of the original dimensions of the playing court. Many design and playing factors which will be discussed hereinafter must be concurrently considered if a superior rebound wall construction is to be provided.

Prior rebound wall systems wherein wall members were adhesively secured to the receiving surface do not combine within the adhesive the properties of elastomeric cushioned response with substantial resistance to both expansion movement and buckling caused by stresses induced by moisture in the wooden or composition wall members in combination with an ability of the adhesive to overcome relatively non-planar receiving surface conditions.

U.S. Pat. No. 3,405,493 discloses a wall construction which is adapted particularly to playing courts. The wall construction shown in U.S. Pat. No. 3,405,493 is excellent. It provides a wall construction having superior characteristics including uniformity of rebound, an intermediate profile, quietness of play, dimensional stability in the presence of changing atmospheric conditions, and the like. However, the components which comprise the wall construction in U.S. Pat. No. 3,405,493 are quite expensive. Further, a great deal of skilled labor is required to properly install the wall construction which very substantially adds to the expense thereof. In view of the rapidly increasing popularity of indoor athletic events which require a rebound wall, it has become essential to develop a rebound wall which is inexpensive and easy to install and yet provide all the characteristics required for an excellent rebound wall.

The present invention is directed to a rebound wall surfacing system and a method of constructing the same which provides a surface having excellent player and design properties and yet which is inexpensive from both a material and labor viewpoint. A curable adhesive and cohesive elastomeric material is preferably troweled onto the receiving surface to which the wall members are to be adhered. A concrete primer, such as Silane, may be used to improve the grip between the urethane elastomer and a concrete or plaster receiving surface. The receiving surface may be a concrete block wall, plaster surface wall, poured concrete wall, wood surface wall or the like. Concrete blocks are the most common type of receiving surface.

Wall members are preferably initially secured to the receiving surface by the application of pressure to the outer faces of the wall members. The troweled material exerts an initial grabbing force on the rebound wall members when they are pressed into the uncured adhesive ridges. Such pressure can be applied by the use of brads, hardened steel cut nails, hand pressure, or the like, depending on the type and weight of the wall member being utilized.

The wall members are normally ½ inch thick or 5/16 inch thick and are preferably made of relatively inexpensive high density particle board panels or inexpensive hard wood members. Preferably, if a high density particle board is utilized, the specific gravity of this type of panel should be about 1.0. Various particle boards meeting this description are commercially available. When mechanical fastening means are used to secure the wall members to the receiving surface, mechanical means may be intentionally overdriven, and the face of the wall members filled so as to provide an unblemished playing surface. Alternatively, the mechanical fastening means may be withdrawn after the elastomeric adhesive has cured, and the face of the wall members may be filled so as to provide an unblemished wall surface.

A non-shrinking bridging elastomeric material which will become both adhesive and cohesive when cured is troweled onto the receiving surface. The material may also be troweled onto the rear face of the wall members; but, in the preferred embodiment is troweled onto the receiving surface. The trowel is designed to apply the material in ridges of predetermined configuration and spacing. When the wall members are pressed against the receiving surface, the uncured troweled material is essentially flattened to an overall thickness of approximately 1/16 inch which is the desired final average thickness of the material. The crushed troweled material will be somewhat thicker at those locations where the depressions in the receiving surface occur.

In the preferred form of the invention, a mastic consistency urethane material is used, which, after it cures to a rubber-like form, provides cushioned impact support for the wall members and acts additionally as an adhesive to prevent movement of the wall members either with respect to the receiving surface or to each other. As the urethane cures and becomes solid and elastomeric, there is substantially no change in volume which might otherwise tend to reduce its bridging capacity and create voids between the wall members and the receiving surface. An acceptable adhesive material is Versaturf 360, a trademarked two-component cellular or non-cellular filled urethane elastomer marketed by Powerlock Systems, Inc.

The material may be a relatively low viscosity liquid urethane which can be thickened by the addition of powdered fumed colloidal silicon dioxide. I have found that approximately a two and one half to one ratio by volume of powder to liquid urethane material produces the desired mastic consistency. While the liquid material could be chemically thickened by the addition of diethylene triamine, I have found that the required mixing precision is difficult to achieve under field conditions. Accordingly, thickening with powdered silicon dioxide is preferred. A suitable powdered material is commercially available from Cabot Laboratories and is sold under the trademark "CAB-O-SIL".

The powdered material permits the consistency of the elastomeric material to be thickened to a suitable mastic consistency so that it is readily trowelable and will not sag during placement of the wall members onto the receiving surface.

The cured urethane exerts a substantial permanent fixed adhesive force between the rear faces of the wall members and the receiving surface while permitting minor longitudinal shear strain to be accommodated without affecting the adhesive grip of the elastomeric material. This is significant in view of the constant minor longitudinal movement which occurs in concrete block walls as a function of varying temperature and moisture conditions. Other suitable materials can be used without departing from the present invention.

In the preferred embodiment, the ridges are approximately ¼" wide, are approximately 3/16" high, and are spaced from one another by approximately ½".

Adjacent wall members may be provided with conventional tongue and groove interlocking means, or they may be square edged. Because of the applied viscosity of the elastomeric adhesive material, no provision is required to prevent oozing or leaking of the uncured elastomeric material through the joints of adjacent wall members.

In the preferred embodiment, the rebound wall is erected by erecting a horizontal section of wall members from wall-to-wall before erecting the next higher adjacent horizontal section of wall members.

Prior to painting the wall face, the seams between adjoining wall members can be sanded and filled to insure removal of any projecting lips and to fill any voids between wall members.

There are numerous design and player considerations which must be simultaneously solved if a wall system is to be considered of tournament quality. The following factors are those which are most important to the construction and design of tournament quality rebound walls.

1. Quality and uniformity of rebound: Since the spaced cured ridges of elastomer are relatively closely spaced on the receiving surface, there are effectively no voids behind the wall members which could create a differential impact response. This insures that the entire rebound wall system has an impact response which is totally uniform. Also, the gaps resultant from the spacing between ridges of the cured elastomer cooperate with the cushioned resiliency of the cured adhesive ridges to give an excellent cushioned ball impact response, avoiding what is normally referred to as a "fast wall" which is undesirable in the game of squash. The rebound effect can be controlled by varying the spacing and thickness of the ridges of cured elastomer as well as by modifying the durometer thereof. The preferred durometer of the elastomeric material is 40 to 65 on a Shore A-2 hardness scale. Additionally, the size and thickness of the wall members influence the rebound response of the wall system. Thus the system can be modified to cushion impacts to a desired degree.

2. Stability: The high gripping and tensile strength of the elastomeric adhesive assures the ability of the rebound wall system to resist expansion movement or buckling separation of the wall members from the receiving surface.

3. Cost: It is believed that the system utilizes materials which reduce to a minimum the cost of tournament quality rebound walls. Further, since the method of installation is relatively simple and rapid, labor costs are ketp at a minimum. While urethane is a relatively expensive product, the amount of urethane used is not great since the ridges are spaced, and since only approximately a 1/16" average thickness of the cured urethane ridges is present between the rear faces of the wall members and the receiving surface after the wall members have been pressed against the receiving surface. The spaced troweled ridges of urethane with resultant voids between ridges keep usage of this expensive material at a minimum.

4. Availability of materials: The wall members utilized for this rebound wall are readily commercially available. Additionally any one of a variety of wall members would be acceptable, although the preferred type is a panel consisting of high density particle board ½ inch thick. Alternatively, short narrow pieces of maple 5/16 inch thick may be utilized. The anchors used to secure the high density panels to the receiving surface can be of any of a wide variety of commercially available anchors. Depending upon the type of receiving surface, masonry nails, nail, screws, or the like may be used. The material to be troweled onto the receiving surface can be a commercially available two-component non-solvent urethane system or the like. The powdered silicon dioxide is readily commercially available.

5. Profile depth: In renovating existing playing courts it is important that the profile depth of the new wall system be held to a minimum or the original court dimensions could be reduced to a degree rendering the court unsuitable for tournament play. Even with respect to new installations, a minimum profile depth permits the internal dimensions of a building to be held to a minimum thereby reducing building construction expense. In the preferred embodiment, the total profile depth of the rebound wall is approximately 9/16". The profile depth includes the 1/16" thick ridge of cured urethane and the preferred ½" thick panel spaced from the receiving wall by the cured ridges of urethane. Obviously, if the receiving wall is not substantially planar, the uncured troweled on material, when applied over minor depressions in the receiving surface will be forced into the minor depressions so that the cured ridges will bridge the depressions and the panels will provide a substantially planar rebound surface. It is believed that the instant wall provides a minimal profile depth without sacrificing quality or playability. If the 5/16" hardwood wall members are used, the profile depth will then be only ⅜".

6. Speed of installation: With regard to renovating existing courts, minimizing down time of the court is very important to insure against lost revenue. With respect to new courts, rapid installation permits prompt usage of the court. Accordingly, it is important that the wall system be installed as rapidly as possible. In view of the minimum number of components comprising the wall system of the present invention and the uncomplicated method of installation the same, maximum speed of installation is obtained.

7. Quietness during play: In view of the restricted confines of a playing court, it is important that the ball impact sounds be as reduced as possible. The cured urethane substantially absorbs and eliminates vibration in the face of a wall member as a ball strikes the wall member at any location, thus controlling the noise resulting from vibration. Uniformity of sound is of major assistance to players in judging the speed with which an opponent has hit the ball.

8. Planarity: The outer faces of the wall members remain planar even if portions of the receiving surface are depressed. This is achieved by forcing the spaced ridges of uncured troweled material into such depressions during erection and allowing the troweled material to cure, elastomerically bridging the depressed portions of the receiving surface. This is especially significant when the receiving surface is a concrete block wall since concrete blocks are well known for their lack of dimensional uniformity, and since concrete block receiving walls are among the most common of receiving surfaces. A planar wall surface contributes substantially to uniform ball rebound. 9. Maintenance: Almost no maintenance is required with respect to the rebound wall system of the present invention. Essentially no structural depreciation resulting from impacts and vibration is encountered. Surface cleaning of the rebound wall system is greatly simplified in view of the smoothness of the wall.

For the purpose of illustrating the invention, there are shown in the drawings forms which are presently preferred, it being understood, however, that this invention is not limited to the precise arrangements and instrumentalities shown.

Figure 1:
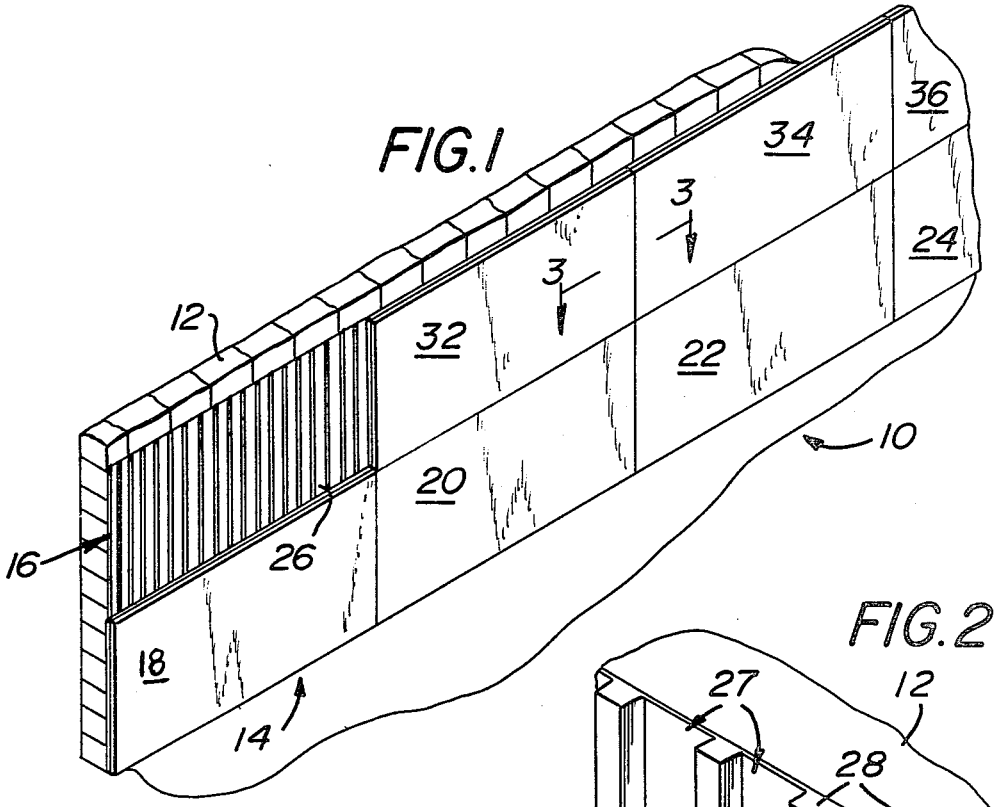
FIG. 1 is a fragmentary perspective view of a rebound wall constructed in accordance with the present invention.
Figure 3:
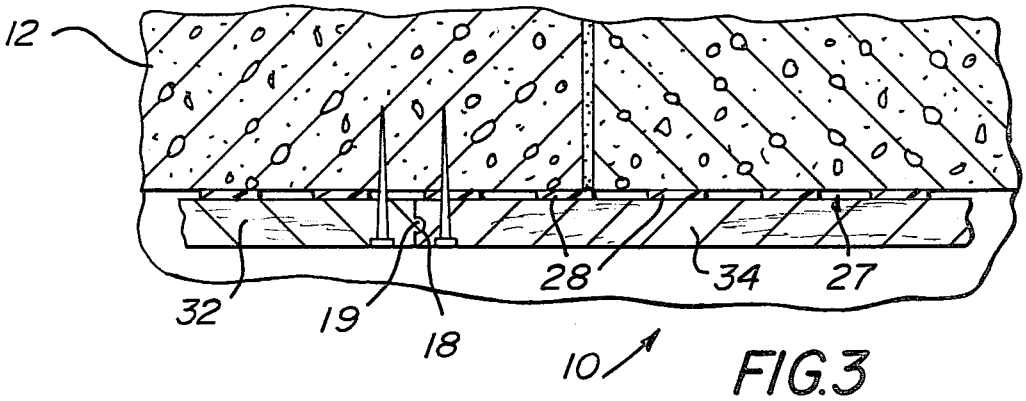
FIG. 3 is a section view taken along lines 3—3 of FIG. 1.

Referring now to the drawings in detail wherein like numerals indicate like elements throughout the first three views, there is shown in FIGS. 1 and 3 a rebound wall system generally indicated by reference numeral 10. The wall system is adapted to be secured to a continuous receiving surface 12. The receiving surface 12 may be a concrete block wall as shown, plaster surfaced wall poured concrete wall, wood wall, or the like. The surface 12 may be an exterior wall, an interior partition wall, or other substantially vertical support but must have adequate strength and rigidity to provide support for the rebound wall system.

For purposes of illustration, two typical rows of panels 14 and 16 are shown and will be discussed. As illustrated in FIG. 3, the panels may be provided with a groove 17 and with a tongue 19 to insure a tight interlocking engagement between the panels. While aligned vertical placement of panels as shown is desired, the vertical joints between panels may be staggered with respect to adjacent rows of panels without departing from the spirit and scope of the invention.

The row 14 includes panels 18, 20, 22 and 24 which are preferably secured to the receiving surface 12 by any suitable conventional mechanical means. The fastening means may take the form of masonry anchors such as shown at 25, or the like. Since the shaft of the mechanical attaching means 25 will preferably be driven through the panel 18 into the surface 12, the composition of the surface 12 will determine the exact type of fastening means to be used.

The mechanical fastening means 25 may be intentionally overdriven and the depressions thus created in the face of the panels may be filled to provide a smooth uninterrupted surface for the wall face.

The panels in each row are preferably four feet by eight feet (4'×8') and are preferably installed with the long dimension horizontal for ease of handling. In the preferred embodiment, the panels will be approximately one half inch thick (½") although the thickness of the panels may be varied without departing from the spirit and scope of the present invention.

Figure 2:
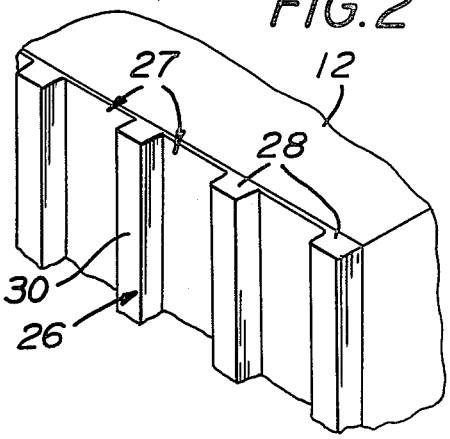
FIG. 2 is a partial perspective view of a receiving surface having material troweled thereon.

An elastomeric urethane material 26 is troweled onto the receiving surface 12. The trowel is specially shaped to apply material 26 in spaced ridges 28 as illustrated in FIG. 2.

Ridge 28 is approximately 3/16" thick and ¼" wide. Ridge 28 is spaced from ridge 30 by approximately ½" although a thin application of material will exist between ridges.

In erecting the rebound wall the first panel to be applied to the wall for purposes of the ensuing description will be panel 18. The panel 18 is pressed against the receiving surface 12 and the ridges of material 28 are contacted and partially displaced with the material 26 filling minor depressions in the receiving surface 12. After panel 18 has been pressed against receiving surface 12, the fastening means 25 as shown in FIG. 3 will be used to hold panel 18 in its desired disposition as material 26 cures.

As shown, gaps 27 exist between adjacent ridges of adhesive material 26. After the ridges 28 cure, the ridges in cooperation with the gaps 27 provide the desired resilient cushioning for the rebound wall 10. The resilient cushioning for the system 10 is greater than would be obtained if the gaps 27 were not provided and enough adhesive were troweled on to provide a solid layer once compressed.

However, it is within the scope of the present invention in instances wherein maximum restraint of the panels is desired, the spacing of the ridges may be ¼" so that, when compressed, a substantially continuous layer of adhesive and cohesive elastomeric material is provided behind the panels.

Thereafter, panels 20, 22 and 24 are erected in a like manner to panel 18 seriatum. This procedure is continued until panels extend from wall to wall.

Panels 32, 34, and 36 can be erected in a like manner. As shown in FIG. 1, the receiving surface 12 has been partially covered with the troweled material 26 so that it is prepared to receive a panel adjacent panels 18 and 32.

The material 26 is preferably a liquid two-component urethane which, when cured, provides bridging elastomeric support for the panels and acts as an adhesive to secure the panels to the receiving surface 12. As the urethane cures, it has volumetric stability which prevents shrinkage. The liquid urethane it thickened to a trowelable mastic consistency before being applied by the addition of an inert powdered filler material such as fumed colloidal silicon dioxide, in a ratio of two and one half parts of powder by volume to one part of liquid urethane. The desired minimum space between the panels and the receiving surface is approximately 1/16" with the maximum space being generally on the order of ⅛" or less where depressions in the receiving surface are encountered.

The anchors 25 can be of a particular type, such as hardened cut nails, permitting withdrawal of the anchors once the urethane material 26 has permanently cured. The adhesive and cohesive strength of the urethane, once cured, obviates the need for the anchors. Holes left in the faces of panels can then be filled.

Figure 4:
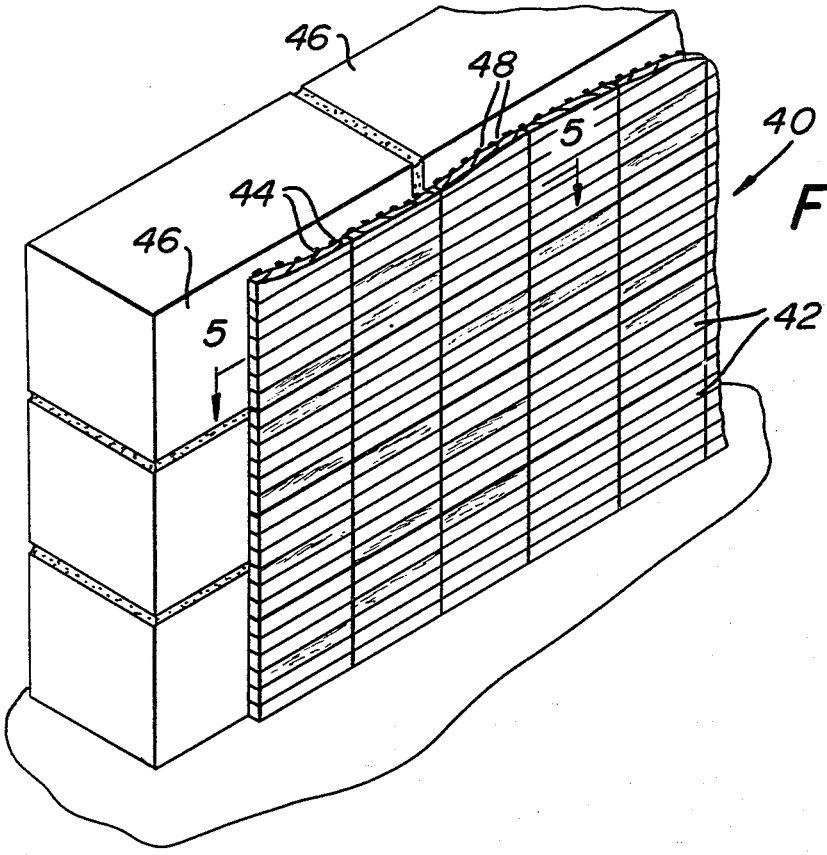
FIG. 4 is a fragmentary perspective view of another embodiment of a rebound wall constructed in accordance with the present invention.
Figure 5:
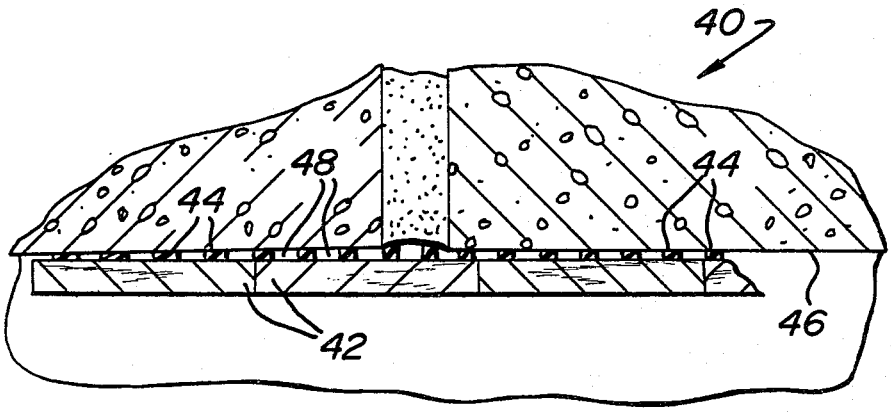
FIG. 5 is a section view taken along lines 5—5 of FIG. 4.

An alternative embodiment of the present invention is illustrated in FIGS. 4 and 5. Therein, the wall system 40 may include wall members in the shape of rectangular tiles 42 each of which is aligned in a uniform direction. The tiles 42 are applied transverse to the ridges of adhesive 44 on the receiving surface 46. The tiles 42 are approximately five and one-half inches long, five-sixteenths inch thick and approximately fifteen-sixteenths inch wide.

The tiles 42 may be installed in a parquet pattern. Wood flooring tiles of other shapes may also be used. The tiles 42 are placed in a tight abutting relationship and pressed into the ridges 44 in order to create a tightly jointed resiliently cushioned adhesive-applied bridged rebound wall system. When the wooden tiles 42 are installed in a parquet pattern, the adhesive ridges should be approximately at a 45° angle to the longitudinal axis of the tiles.

Normally, twenty-four tiles 42 are installed at one time and may be held together by gauze or any other conventional holding means. Preferably, the holding means will be on the outer surface of the tiles so as not to adversely affect the adhesion of the tiles to the ridges. In view of the light weight of the tiles 42, it is possible to completely avoid the use of anchors or other holding means. The initial grabbing strength of the adhesive is sufficient to hold the tiles 42 in place while the adhesive cures. If desired additional conventional anchor means may be used without departing from the spirit and scope of this invention.

Planarity of the tiles 42 can be assured by the application of weight to a rigid planar sheet overlying a plurality of tiles 42 to seat the tiles in the uncured ridges of adhesive.

The wall system 40 is erected in substantially the same manner as wall system 10. In either embodiment, the troweled ridges of adhesive could be applied to the wall members rather than the receiving surface. However, for ease of installation, among other reasons, application of the ridges to the receiving surface is preferred.

As shown in FIG. 5 the receiving surface 46 is not planar. As shown, the uncured ridges 44 are crushed and displaced differentially as a function of the distance between the wall members and the receiving surface. Accordingly, the gaps 48 between ridges may not be uniform since the lateral displacement of each displaced ridge will frequently be different to accommodate minor non-planarity on the receiving surface and provide bridging for the wall system.

The wall members may be any conventional type board, tile, block, plywood or Masonite sheets or the like. The wall members may be made of compressed wood, Masonite, wood chipboard, plywood, oak or maple and may, in fact, comprise the least expensive wall members available.

In the preferred embodiment of the invention, the outer face of each of the panels is painted. Prior to painting, the seams between the panels are sanded to insure smoothness of the panel and planarity between each of the panels by removing any projecting lips.

The present invention may be embodied in other specific forms without departing from the spirit or essential attributes thereof and, accordingly, reference should be made to the appended claims, rather than to the foregoing specification as indicating the scope of the invention.

I claim:

1. A method of constructing a resiliently cushioned rebound wall surfacing system on a substantially continuous vertical receiving surface wherein the rebound wall system includes a plurality of abutting vertically disposed wall members spaced from the vertical receiving surface, the method comprising the steps of providing a plurality of relatively thin wall members, applying a trowelable curable elastomeric non-shrinking material in a ridged pattern, onto at least one of the rear faces of the wall members and the receiving surface, pressing the wall members against the receiving surface to force the material against both the receiving surface and the rear face of the wall members so that a resultant average desired cushioning thichness of material is achieved, initially holding the wall members to the receiving surface with the wall members being spaced from the receiving surface by the elastomeric material and permitting the material to cure to a state wherein said adhesive has a specific height when not under load, and is deformable with desired cushioning to a lesser height when under load and returns substantially to said original height when said load is released and bonds the wall members to the receiving surface and provides resilient cushioning for the rebound wall system.

2. A method of constructing a rebound wall as set forth in claim 1 wherein the step of applying the elastomeric material includes troweling the material in said ridged pattern onto the receiving surface such that the material is applied in a series of spaced ridges which when contacted and displaced, will provide a predetermined layer of material of substantially uniform average thickness between the wall members and the receiving surface.

3. A method of constructing a rebound wall as set forth in claim 1 wherein the step of applying the elastomeric material includes troweling the material in said ridged pattern onto the rear faces of the wall members such that the material is applied in a series of spaced ridges which when contacted and displaced, will provide a predetermined layer of material of substantially uniform average thickness between the wall members and the receiving surface.

4. A method of constructing a rebound wall as set forth in claim 1 wherein the step of applying the elastomeric material includes troweling the material onto the receiving surface in said spaced ridges, providing substantial spaces between at least some of the applied ridges such that after the wall members are pressed against the material and the material is contacted and displaced, gaps remain between at least some of the ridges after the ridges are cured, the gaps and the cured ridges cooperating to provide desired resilient cushioning for the rebound wall system.

5. A method of constructing a rebound wall as set forth in claim 1 wherein the step of applying the elastomeric material includes troweling the material onto the wall members in said spaced ridges, providing substantial spaces between at least some of the applied ridges such that after the wall members are pressed against the material and the material is contacted and displaced, gaps remain between at least some of the ridges after the ridges are cured, the gaps and the cured ridges cooperating to provide desired resilient cushioning for the rebound wall system.

6. A method of constructing a resiliently cushioned rebound wall as set forth in claim 1 including the step of thickening the curable adhesive by adding fumed colloidal silicon dioxide thereto to provide the desired viscosity in the trowelable material.

7. A method of constructing a resiliently cushioned rebound wall as set forth in claim 1 including the step of thickening the curable adhesive by adding diethylene triamine thereto to provide the desired viscosity in the trowelable material.

8. A resiliently cushioned rebound wall surfacing system to be secured to a substantially continuous vertical receiving surface comprising a plurality of wall members secured to said receiving surface, the outer surfaces of said wall members lying in a substantially vertical plane, an elastomeric trowelable non-shrinking material which is adhesive and cohesive when cured located between said wall members and said receiving surface, said material being applied in its uncured state to at least one of the rear faces of said wall members and said receiving surface, said material having a thickened consistency so that said material is trowelable when applied, said uncured material being displaced upon the application of force on a wall member against the receiving surface such that said wall member is spaced from said receiving surface a predetermined distance by said material, said elastomeric material in its cured state having a specific height when not under load, and being deformable with desired cushioning to a lesser height when under load and returning substantially to said original height when said load is released.

9. A rebound wall surfacing system as set forth in claim 8 wherein said adhesive and cohesive material includes a two component filled urethane elastomer and approximately two and one-half times the volume of an inert powdered filler material used as a thickening agent, said adhesive and cohesive material being applied in a series of spaced ridges such that after the material is displaced gaps exist between at least some of said ridges, said cured ridges and said gaps cooperating to resiliently cushion said wall system.

10. A rebound wall surfacing system as set forth in claim 8 wherein a diethylene urethane thickener is added to the elastomer material so that the desired trowelable consistency is obtained.

11. A rebound wall surfacing system as set forth in claim 8 wherein said material is compressed to a substantially uniform layer, said members being spaced from said receiving surface solely by said material.

12. A rebound wall surfacing system as set forth in claim 8 wherein said uncured material is applied in a series of spaced ridges such that after the material is displaced gaps exist between at least some of said ridges, said cured ridges and said gaps cooperating to resiliently cushion said wall system.

13. A rebound wall surfacing system as set forth in claim 9 wherein the inert powdered filler material comprises fumed colloidal silicon dioxide.

* * * * *